United States Patent [19]

Hollick

[11] Patent Number: 4,739,526

[45] Date of Patent: Apr. 26, 1988

[54] LIFTING APPARATUS FOR USE IN LIFTING A DISABLED PERSON OR PATIENT

[76] Inventor: Christina B. Hollick, Top of the Hill, Shantock Lane, Bovingdon, Hertfordshire, United Kingdom, HP3 0NG

[21] Appl. No.: 46,104

[22] Filed: May 5, 1987

[30] Foreign Application Priority Data

Jul. 5, 1987 [GB] United Kingdom ..... 8616449

[51] Int. Cl.[4] ..... A61G 7/10; A61G 1/00

[52] U.S. Cl. ..... 5/83; 5/86; 5/89

[58] Field of Search ..... 5/81 R, 83, 86, 87, 5/89, 122, 445; 297/274, 275

[56] References Cited

U.S. PATENT DOCUMENTS 2,688,410 9/1954 Nelson ..... 5/86 X 3,234,568 2/1966 Fischer ..... 5/89

FOREIGN PATENT DOCUMENTS 1046202 1/1979 Canada ..... 5/89

1094405 12/1967 United Kingdom ..... 5/81 R

*Primary Examiner*—Alexander Grosz

*Assistant Examiner*—Michael F. Trettel

*Attorney, Agent, or Firm*—Jones, Day, Reavis & Pogue

[57] ABSTRACT

A lifting apparatus, for lifting disabled persons, including a harness, which is front-fitting so that it can be fitted and removed with ease and speed by disabled users themselves because it does not have to be placed from the back underneath the buttocks. The harness, nevertheless, provides maximum safety and comfort as straps self-position to ensure a vertical lift even from the prone position. The harness is used in conjunction with a suspension frame which has four points to which the harness also attached from the front easily and quickly. The frame is shaped and dimensioned so that a safe stable comfortable and upright sitting position is achieved throughout a lifting operation. The disabled user can thus be more independent as manual propping up in a wheelchair by a helper is unnecessary as the risk of slipping off does not arise. The frame also incorporates a stirrup-bar which eliminates the need for a separate, heavy, monkey pole and grab handle.

7 Claims, 6 Drawing Sheets

LIFTING APPARATUS FOR USE IN LIFTING A DISABLED PERSON OR PATIENT

Figure 1:
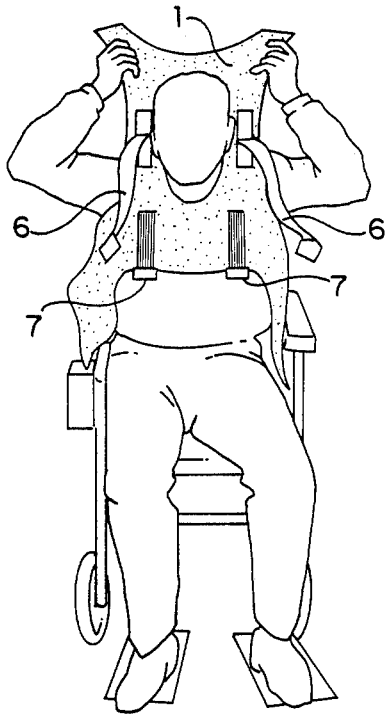

This invention relates to a lifting apparatus for use in lifting a disabled person or patient.

Lifting apparatus available at present for disabled people and their carers consists of a sling and spreader bar used in conjunction with a hoist. In spite of a wide variety in the design of these slings, their common fault is that they have to be fitted and removed from the back and placed underneath the buttocks. This makes them extremely difficult and time-consuming to use. The safety factor itself is questionable. Unless the disabled person positions himself centrally he can overbalance out of the sling. In the case of severely disabled patients, it is usually necessary for a nurse or carer to roll them from a lying position onto the existing one-piece type of hammock sling and to correctly position the commode aperture. This is uncomfortable and undignified for the patient while putting a strain on the attendant's back. Moreover such a harness cannot be fitted or removed from a sitting position and may therefore have to remain in situ during the day.

The spreader bar available at present is hangar-shaped with both back and buttock loops fastening over open hooks at the same point on the respective side of the bar. This invariably causes the occupant of the sling to end the lifting operation on the small of the back instead of the necessary upright sitting position. The safety factor is again questionable as there is a risk of the loops slipping out of the hooks when straps are slack in descent.

It is an object of the present invention, in one of its aspects, to provide an improved harness by which at least some of the above-noted disadvantages may be avoided.

According to the present invention there is provided a harness for use in lifting a disabled person, or patient, in substantially a seated or semi-prone position, and which, when fitted includes a first portion which extends around the chest and over the shoulders of the wearer, and has suspension members extending upwardly, on either side of the wearer, from the region of the wearers shoulders, and a further portion or portions which extends or extend around the thighs of the wearer, and is or are connected to further suspension means extending upwardly from the wearer's thighs, and wherein said further portion or portions and said first portion are connected by portions extending on either side of the wearer, leaving the back and buttocks clear, the arrangement being such that the harness can be fitted to a patient in a seated or prone position without raising the buttocks or lower back region of the patient from the chair, bed or the like on which the patient is initially resting, to allow the patient to be lifted by means of the harness, by way of said suspension members.

Thus, a harness embodying the invention can be fitted from the front of the patient, without the need to raise the patient bodily and can readily be designed so as to be capable of being fitted and removed easily and quickly, and in many cases, depending upon the degree of disability of the patient, this can be done by the patient unaided.

As there is no part of the harness underneath the back and buttocks, it can be easily and quickly fitted and removed even from a severely disabled person in bed or seated without having to move the patient.

According to another aspect of the invention there is provided the combination of a harness according to the invention with a frame from which the harness can be suspended and which provides transversely spaced apart attachment points for the suspension members which extend from the harness on either side of the wearer's head, and a further attachment point or points, spaced longitudinally from said transversely spaced attachment points, for connection with said further suspension means.

Preferably, said further suspension means of said harness comprises two suspension members each extending upwardly, in use, from a respective one of the wearer's legs, and said frame has two said further attachment points, spaced longitudinally forwardly of the attachment points for the suspension members for said first portion of the harness, and wherein said further attachment points are also spaced apart transversely of one another.

Figure 2:
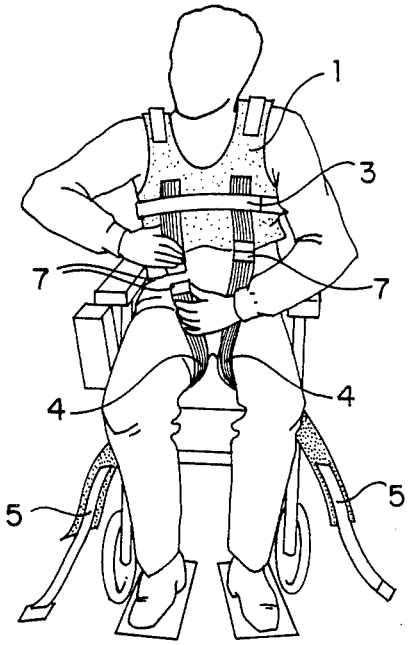
Figure 3:
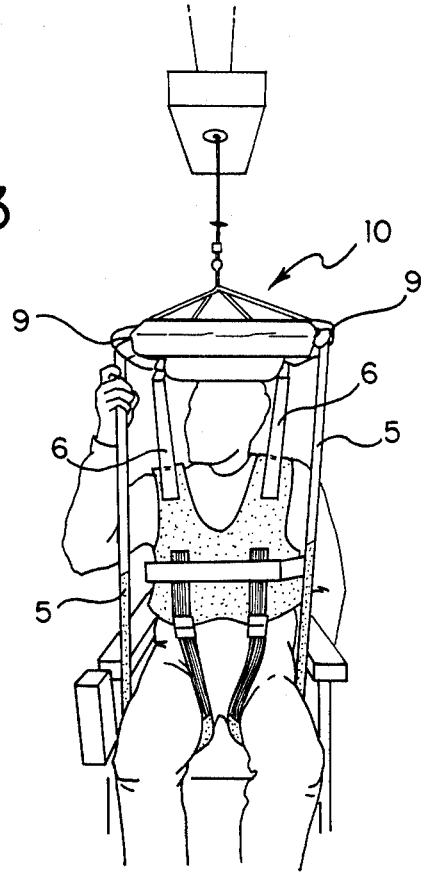
Figure 4:
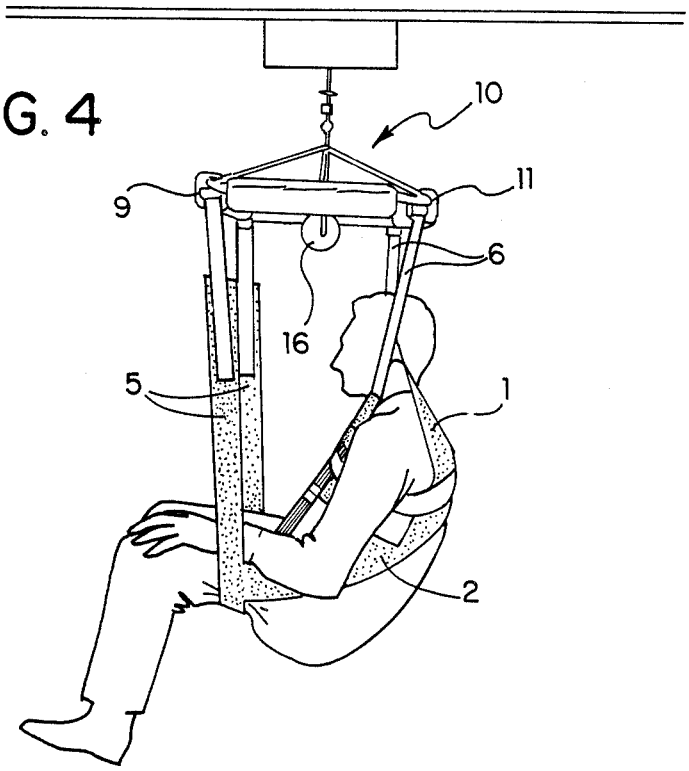
Figure 5:
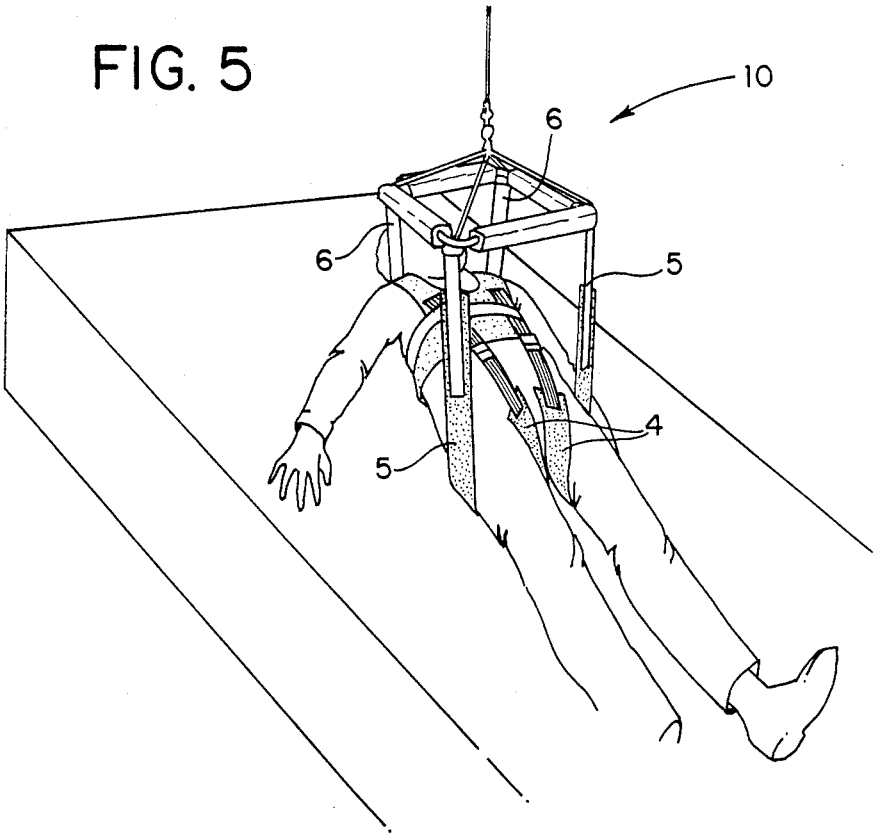
Figure 6:
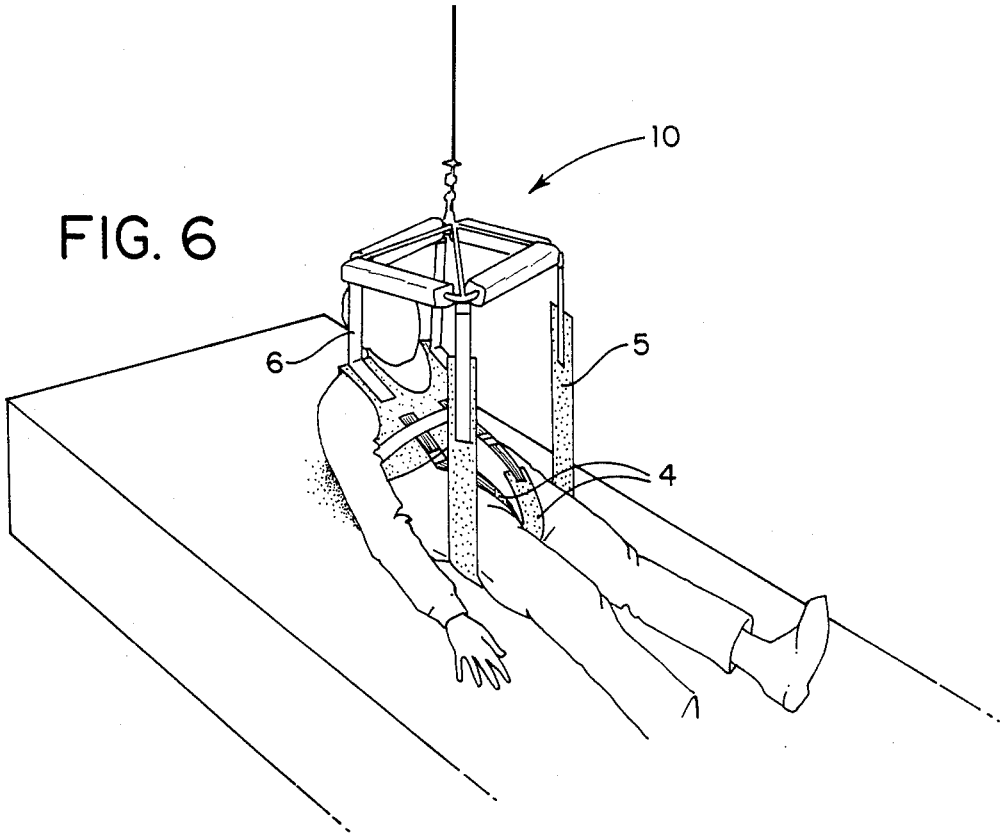
Figure 7:
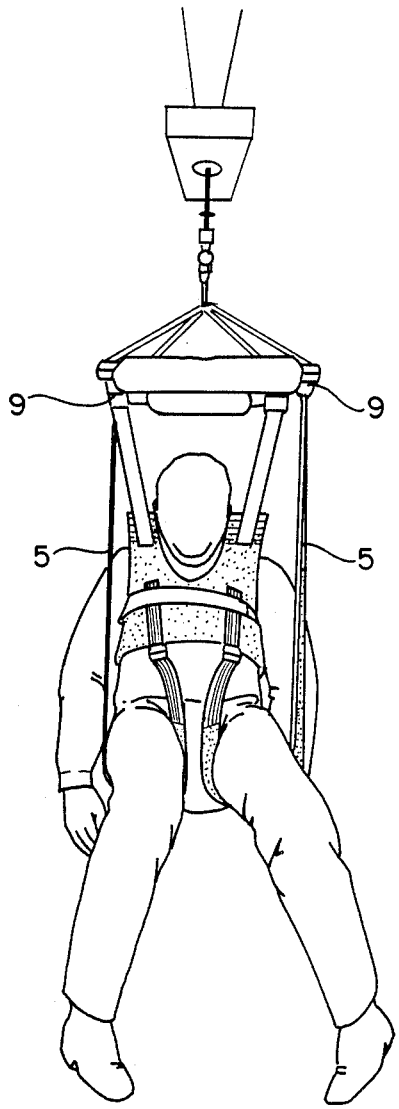
Figure 8:
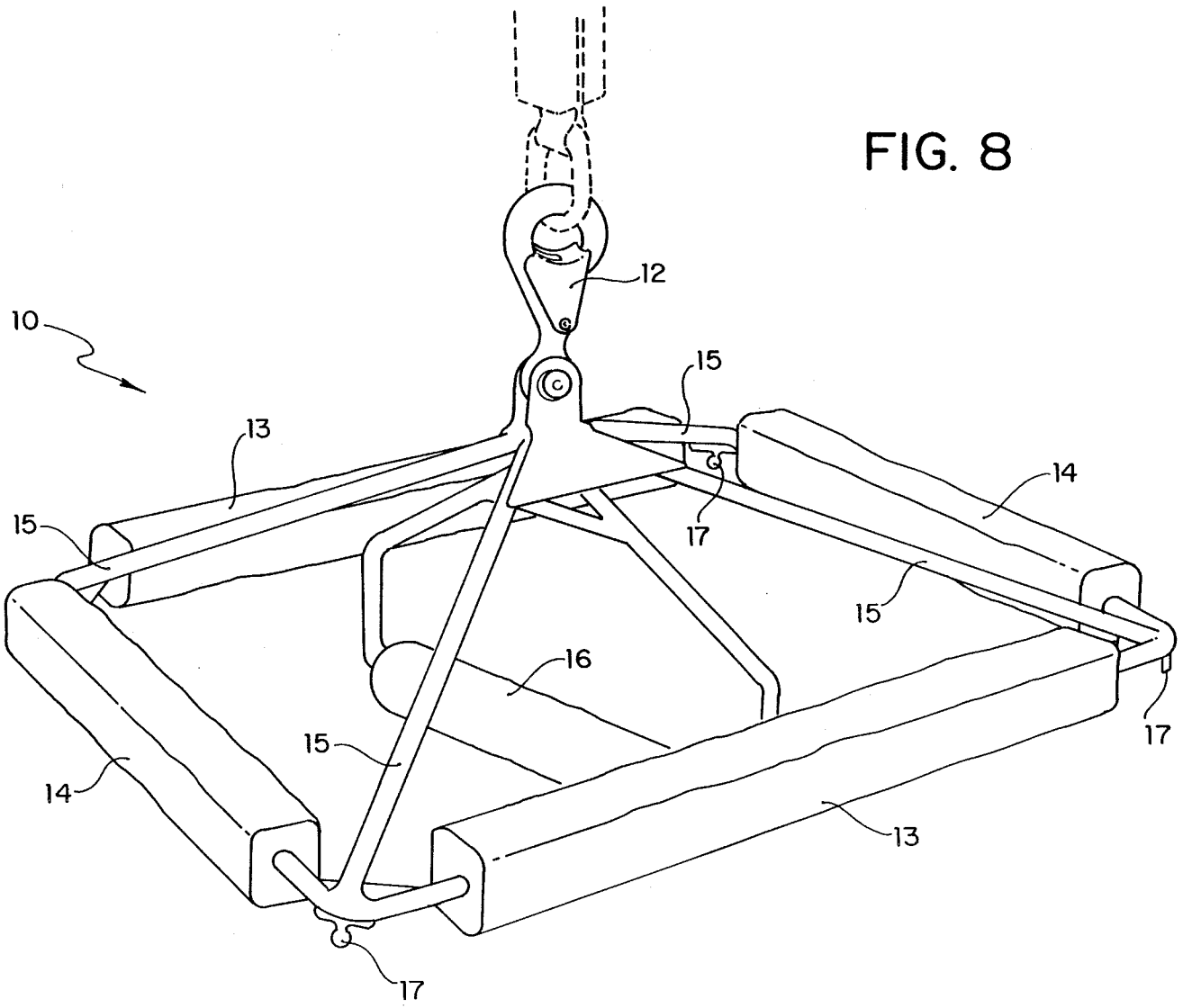
Figure 9:
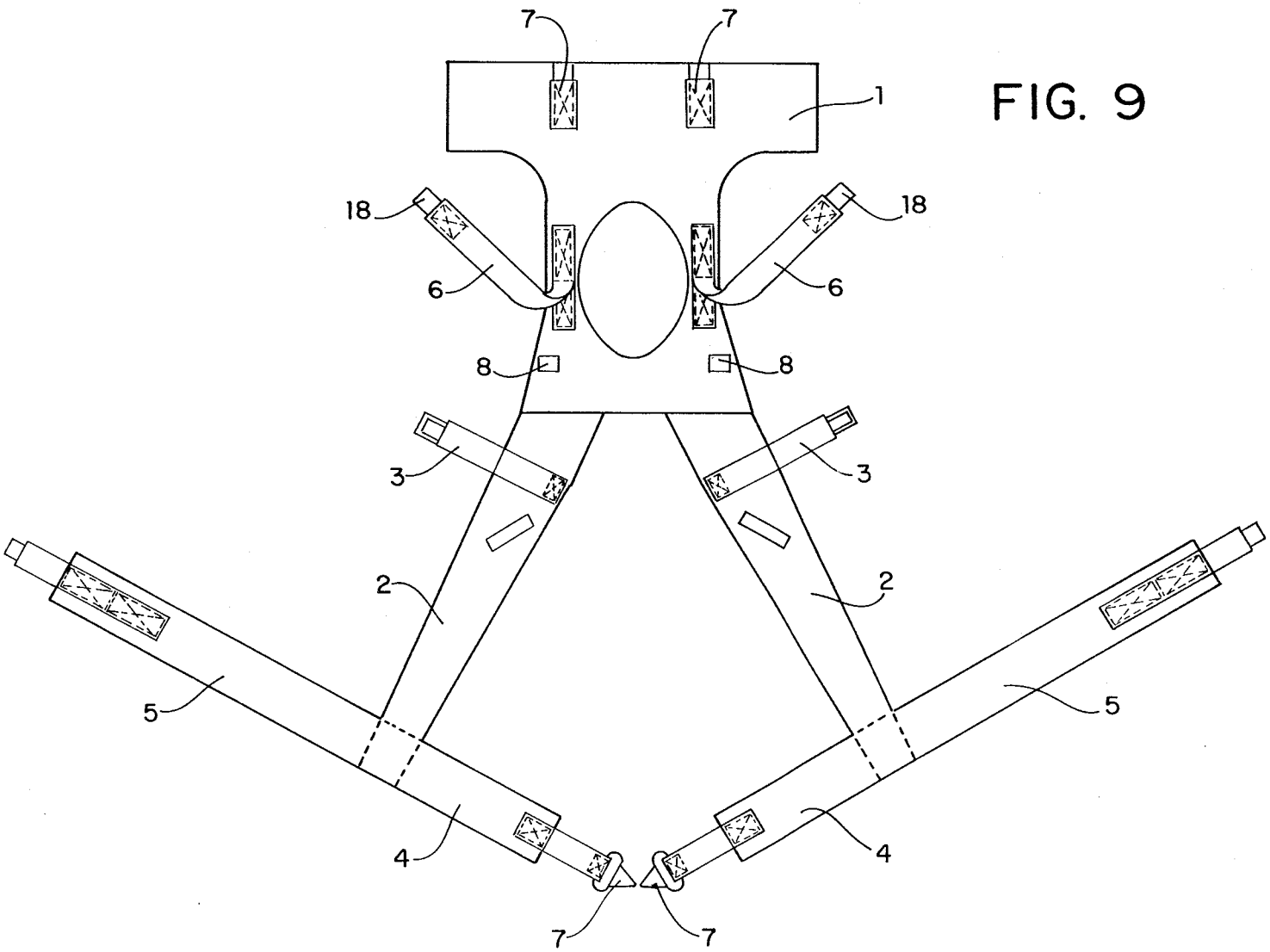

An embodiment of the invention will now be described by way of example with referance to the accompanying drawing in which:

FIG. 1 shows a harness embodying the invention being slipped over the head of a patient from the front of the patient in a first stage of a fitting procedure, FIG. 2 shows padded suspension straps of the harness being clipped into buckles on the chest part of the harness in a subsequent stage in the fitting procedure, FIG. 3 shows suspension straps of the harness being clipped directly into lugs welded on each corner of four-point suspension frame forming part of a suspension system, FIG. 4 is a side view showing the harness and suspension system during lifting of the patient, whilst the patient is in mid-air, FIG. 5 shows the harness and suspension system of FIGS. 1 to 4 at the beginning of a lifting operation on a prone patient, FIG. 6 is a view similar to FIG. 5 but showing a subsequent stage in the lifting operation, FIG. 7 is a view similar to FIGS. 5 and 6 but showing the patient fully raised, FIG. 8 is a perspective view of a suspension frame forming part of a suspension system embodying the invention, and FIG. 9 shows the harness of FIGS. 1 to 7 laid out flat.

Referring to the drawings a preferred embodiment comprises a harness, and a suspension frame (FIG. 8), through which the harness may be connected with a hoist.

Referring to FIG. 9, the harness is made from a strong, supple, water-repellant fabric and includes a portion 1 in a halter shape, and which when fitted to a patient, reaches to the waist in front but only to the top of the shoulderblades behind. Portion 1 has a wide head opening whereby portion 1 can be slipped over the head of the patient from the front of the patient. From the bottom edge of the rear of portion 1, two broad strips 2 extend downwardly one on each side of the harness, the strips 2 diverging downwardly as viewed in FIG. 9.

At the end of each strip 2 remote from portion 1 is secured, at right angles to the respective strip 2, a respective web, the portion of which on the inner side of the respective strip 2 in FIG. 9 forms a shorter suspension strap 4 and the portion of which on the outer side of the respective strip 2 in FIG. 9 forms a larger suspension strip 5. Each strip 2 tapers in width from its point of attachment with portion 1 to its point of attachment with the respective web 4,5. Each strip 2 is preferably adjustable in length by means not shown.

Extending from the outer side of each strip 2, slightly below portion 1, as viewed in FIG. 9, is a respective narrow belt 3.

Further suspension straps 6, shorter than straps 5, are secured to portion 1, on either side of the head opening.

Referring to FIGS. 1 to 4, to fit the harness described above, the portion 1 is slipped over the patient's head, with the strips 2 to the rear, as shown in FIG. 1. The narrow belts 3 are then passed under the patient's arms and across the part of portion 1 which lies over the patient's chest and the belts 3 are secured together by means of touch and close fastening means, across the chest portion of the harness. The broad strips 2 are pulled down past the respective sides of the patient and the webs 4, 5 are passed under the respective legs of the patient. The shorter straps 4 pass upwardly between the patient's legs and are secured at their ends to the front of the portion 1 below belts 3, by respective fasteners 7. The fasteners 7 preferably take the form of positive-lock quick-release buckles, with for example, female parts of such buckles being secured to the front of portion 1 and male buckle parts to the ends of straps 4. The webs 4,5, are preferably padded where they pass under the wearer's legs.

Each longer suspension strap 5 is then lifted to extend on the outside of the respective leg of the patient and is fastened directly to a respective one of two front attachment points 9 of the suspension frame 10 by a positive lock quick-release buckle.

Two shorter suspension straps 6 (FIG. 9) are fastened directly to respective ones of two rear attachment points 11 of the suspension frame by respective positive-lock, quick release buckles. The positions, on harness portion 1, at which the straps 6 are attached, are substantially forward of the rear edge of the head opening in portion 1, (shoulder tabs 8 being provided on each side of portion 1 at approximately the same level as the rear edge of the head opening). This feature ensures that the size of the back flap of the halter, i.e. of the part of portion 1 to the rear of the head opening, can be kept to a safe minimum for easy fit and removal from the front without risk of being pulled off over the head when the lifting operation commences.

This design feature also ensures that this narrow back flap of the halter is so dimensioned to be drawn up only sufficiently to support head and neck comfortably and safely when the lifting operation is in progress—even from a prone position, thus eliminating the need for manual support of the head at the outset of the lifting operation. This feature, in combination with the respective lengths of straps 5 and 6 and the form of the suspension frame, also ensures that when the harness is lifted, with the patient, the head and shoulders of the patient initially in a prone position automatically rise first to ensure a stable upright sitting position from the outset, (see FIGS. 5 and 6).

Referring to FIG. 8, the suspension frame 10 includes a safety release clip 12 by which the frame can be connected to the lifting ring of any hoist (preferably electric). The frame is of rectangular shape and is constructed of steel tube for lightness and strength. The frame comprises two horizontal side members 13 connected by horizontal front and rear members 14 to form a rectangle which is strengthened by diagonal tubes 15 rising from the four corners to an apex in the centre of the frame. Each corner of the rectangle is strengthened by a welded steel gusset. The apex formed by the diagonal bracing tubes forms the mounting point for the for safety release clip 12 and for a freely suspended horizontal stirrup-shaped bar 16 of sufficient width to be gripped by both hands of a patient, with adequate clearance between the hands. The bar 16 is padded and of sufficient diameter to provide a comfortable grip for stiff hands.

To avoid risk of injury to the user when the suspension frame is descending, the front, rear and side members 13,14 of the rectangular frame are also padded. Each of the four corners of the suspension frame has welded to it a respective lug 17 which forms a male part of a respective one of the quick release fastenings by which straps 5 and 6 of the harness are attached to the frame, the female parts 18 of the respective quick-release fastenings being carried by the respective straps. To avoid error, these four female fastener parts 18 are different in colour from the positive lock quick release buckles 7 intended for securing on the chest portion of the harness. The fastener parts 18 on straps 5, and the associated lugs 17, may likewise be coloured differently from the other fastener parts 18 and the other lugs 17.

Because the two front suspension points 9 on the suspension frame, and which support the patient's legs through the harness, are spaced horizontally forwardly of the two rear suspension points 11 which support, through the harness, the upper parts of the patient's body, the patient is maintained in substantially a sitting position during lifting, as shown in FIGS. 4 and 7. Because the front suspension points 9 for the leg straps 5 are spaced apart transversely horizontally, painful pressure between the thighs is avoided. Likewise, the horizontal spacing between the rear suspension points 11 avoids compression across the shoulders of the patient being lifted. The four-point suspension system also ensures that a comfortable, stable and safe lift is ensured.

To avoid risk of injury, slip-on sleeves are supplied to cover the four lugs 17 when only the stirrup-shaped (monkey pole) bar 16 is being used by a disabled person in bed to alter position. For the lifting operation these slip-on sleeves are quickly removed. The dimensions and shape of the suspension system are such that when the patient is in the harness a vertical lift is applied even from a prone position which enables the disabled person to rise and descend in a safe, stable and comfortable upright sitting position throughout the transfer from point to point. Safe stable support is also provided by the right-angled positioning of straps 4, 5 from side strips 2 which self-position to act as arm supports when a lifting operation commences, as shown in FIG. 4.

What is claimed is:

1. A lifting apparatus for use in lifting a disabled person, or patient, from substantially a seated or supine position comprising a harness means which, when fitted, includes a first support means which extends around the chest and over the shoulders of a wearer, and has a first suspension means extending upwardly, on both sides of the wearer, from the region of the wearer's shoulders, and a further support means which extends around the thighs of the wearer, and is connected to further suspension means extending upwardly from the wearers thighs, and wherein said further portion or portions and said first support means are connected by connecting means extending on both sides of the wearer while leaving the back and buttocks clear, the arrangement being such that the harness means can be fitted to the wearer in a seated or supine position without raising the buttocks or lower back region of the wearer from the chair, bed or the like on which a wearer is initially resting, to allow the wearer to be lifted by means of the harness means, by way of both said suspension members.

2. A lifting apparatus according to claim 1, wherein said second suspension means are so arranged as to extend, in use, upwardly on the outside of the wearer'-thighs and also serve to locate the patient's arms reliably in position resting on the thighs.

3. A lifting apparatus according to claim 1, wherein said first support means includes a back panel which in use defines, with a front panel extending across the wearer's chest and shoulder portions extending over the wearer's shoulders, an aperture for the wearer's head and neck, wherein said first suspension means are suspension members connected to respective ones of said shoulder portions, and wherein said back panel is relatively narrow and said first support means so designed that, in use, the first support means, with said back panel, when pulled upwardly by the first suspension means, is also pulled upwardly towards the wearer's head slightly so that the edges of said aperture provide support for the head and neck of the wearer.

4. A lifting apparatus according to claim 1, further including a frame from which the harness can be suspended and which provides transversely spaced apart attachment points for the first suspension members which extend from the harness on both sides of the wearer's head, and further attachment points, spaced longitudinally from said transversely spaced attachment points, for connection with said second suspension means.

5. A lifting apparatus according to claim 4, wherein said second suspension means of said harness means comprises two suspension members each extending upwardly, in use, from a respective one of the wearer's legs, and wherein said frame has two of said further attachment points, spaced longitudinally forwardly of the attachment points for the suspension members for said first support means of the harness, and wherein said further attachment points are also spaced apart transversely of one another.

6. A lifting apparatus according to claim 5, wherein the arrangement is such that the wearer of the harness means, when fully suspended by said frame, has his or her shoulders at a higher level than his or her legs, whereby in lifting the patient from a supine position, the head and shoulders are raised first.

7. A lifting apparatus according to claim 4, wherein said frame also incorporates a transverse trapeze bar adapted for grasping by a wearer wearing the harness means.

* * * * *